US006046536A

United States Patent [19]

Lee et al.

[11] Patent Number: 6,046,536

[45] Date of Patent: Apr. 4, 2000

[54] INNER SHIELD FOR CRT

[75] Inventors: Sam-kyoung Lee; Young-kun Kim; Jae-cheol Lee, all of Suwon, Rep. of Korea

[73] Assignee: Samsung Display Devices Co., Ltd., Kyungki-Do, Rep. of Korea

[21] Appl. No.: 09/093,051

[22] Filed: Jun. 8, 1998

[30] Foreign Application Priority Data

Jun. 28, 1997 [KR] Rep. of Korea ..... 97-28571

[51] Int. Cl.[7] ..... H01J 29/06

[52] U.S. Cl. ..... 313/402; 313/479

[58] Field of Search ..... 313/402, 407, 313/479; 315/85

[56] References Cited

U.S. PATENT DOCUMENTS

| | | | |
|---|---|---|---|
| 3,867,668 | 2/1975 | Shrader | 313/402 |
| 4,792,317 | 12/1988 | Sipsma | 313/402 |
| 5,097,174 | 3/1992 | D'Amato | 313/402 |
| 5,336,962 | 8/1994 | Keller | 313/402 |
| 5,898,259 | 4/1999 | Reyal | 313/407 |

*Primary Examiner*—Michael H. Day
*Attorney, Agent, or Firm*—Leydig, Voit & Mayer, Ltd.

[57] ABSTRACT

An inner shield for a CRT includes first and second side walls facing each other, each side wall having first and second half-side walls extending inward from ends, wherein a coupling piece is located on the first half-side wall and a coupling hole into which the coupling piece is inserted and bent is located in the second half-side wall, the coupling piece and hole coupling first and second half-side walls to each other.

5 Claims, 4 Drawing Sheets

INNER SHIELD FOR CRT

BACKGROUND OF THE INVENTION

1. Field of the Invention

The present invention relates to a cathode ray tube (CRT), and more particularly, to an inner shield for a CRT for preventing terrestrial magnetism from affecting the electron beam emitted from an electron gun.

2. Description of the Related Art

Referring to FIG. 1, a conventional CRT includes a panel 10 having a fluorescent layer 11 located at its inner surface, a shadow mask frame assembly 12 spaced a predetermined distance from the fluorescent layer 11, a funnel 20 sealed to the panel 10, and an electron gun (not shown) installed in a neck portion 21 of the funnel 20.

In the CRT having such a configuration, the electron beam emitted from the electron gun is selectively deflected by a deflection yoke (not shown) according to an image signal to then land on the fluorescent layer 11 and excite the fluorescent layer 11.

However, electron beams emitted from the electron gun may not land precisely on a predetermined portion of the fluorescent layer because of the effect of terrestrial magnetism, according to the place where the CRT is installed. Thus, the proceeding path of the electron beam is surrounded by an inner shield 30 made of metal for shielding from terrestrial magnetism.

The inner shield 30 is constituted by first and second side walls 31*a* and 32*a*. The first and second side walls 31*a* and 32*a* form the inner shield 30 such that first half-side walls 31*b* and 31*b*' and second half-side walls 32*b* and 32*b*', extending inward from their both ends, are coupled to each other. In other words, as shown in FIG. 2, bending hooks 33 and 34 are located at upper of the first and second half-side walls 31*b* (31*b*') and 32*b* (32*b*'), respectively. The bending hooks 33 and 34 are coupled to the upper ends of the corresponding half-side walls so that the first and second side walls 31*a* and 32*a* are coupled to each other. The bending hooks 33 and 34 are located such that extension pieces at upper edges of the half-side walls are bent during assembly.

However, the connection strength of the bending hooks 33 and 34 with respect to the first and second side walls 31*a* and 32*a* of the inner shield 30 is relatively weak. Also, since the bending hooks 33 and 34 are located and then bent for assembly, assembly processes are complicated. Further, the first half-side wall 31*b* or 31*b*' and the second half-side wall 32*b* or 32*b*' tend to slip relative to each other due to vibrations, which causes foreign matter to be generated due to abrasion.

SUMMARY OF THE INVENTION

To solve the above problems, it is an objective of the present invention to provide an inner shield for a CRT having an improved structure so that first and second side walls are securely coupled.

Accordingly, to achieve the above objective, there is provided an inner shield for a CRT including first and second side walls facing each other and having first and second half-side walls extending inward from both ends, wherein a coupling piece is located at one of the first and second half-side walls and a coupling hole into which the coupling piece is bent and inserted is located at the other, to couple the corresponding first and second half-side walls to each other.

The coupling hole has an upside-down trapezoidal shape and the coupling piece has a trapezoidal shape.

The coupling piece extends from the upper end of either the first or second half-side wall.

According to another aspect of the present invention, the coupling piece is located by lancing either the first or second half-side wall.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
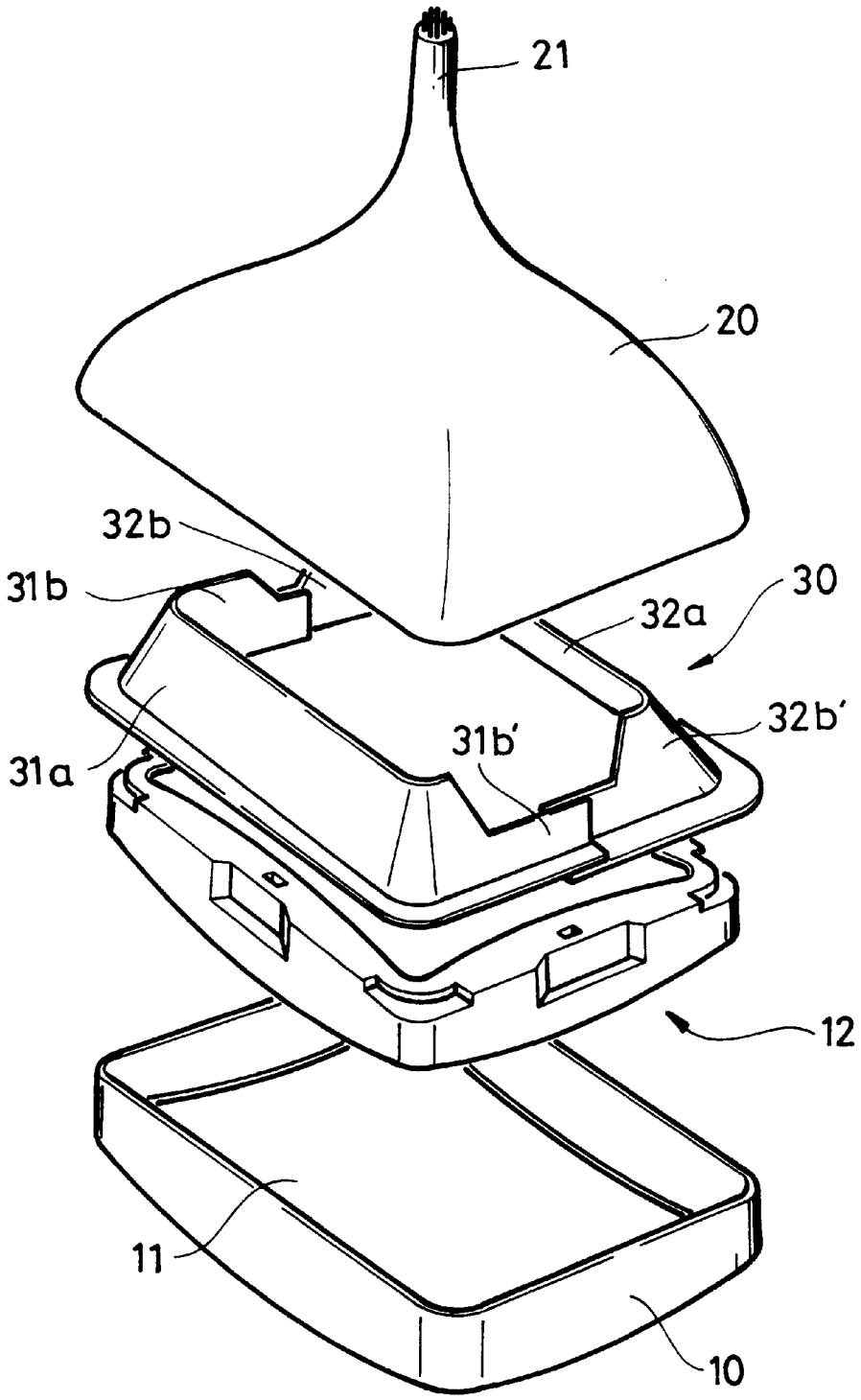
FIG. 1 (PRIOR ART)
FIG. 1 is an exploded perspective view illustrating a general color cathode ray tube (CRT)
Figure 2:
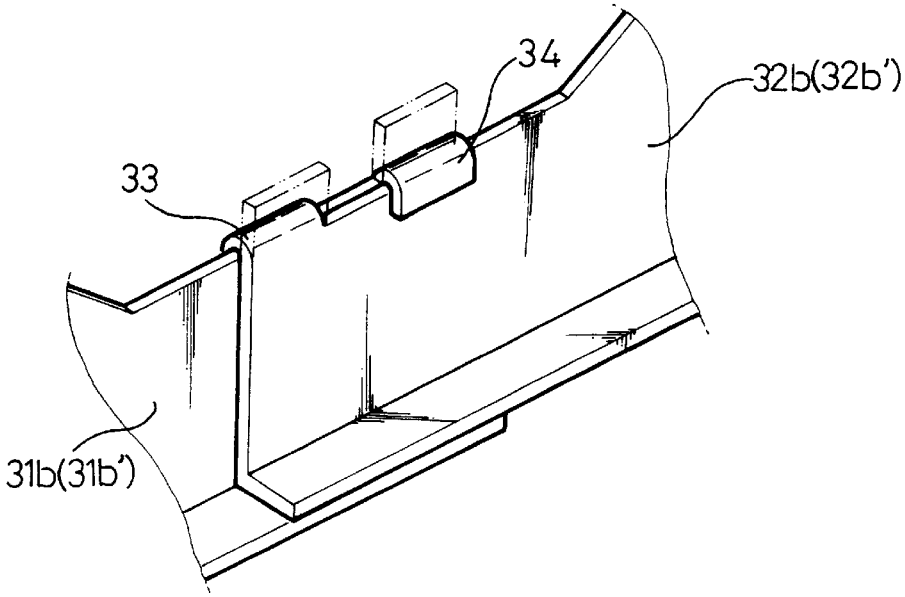
FIG. 2 (PRIOR ART)
FIG. 2 is a partially exploded perspective view illustrating a conventional inner shield employed in the CRT shown in FIG. 1.
Figure 3:
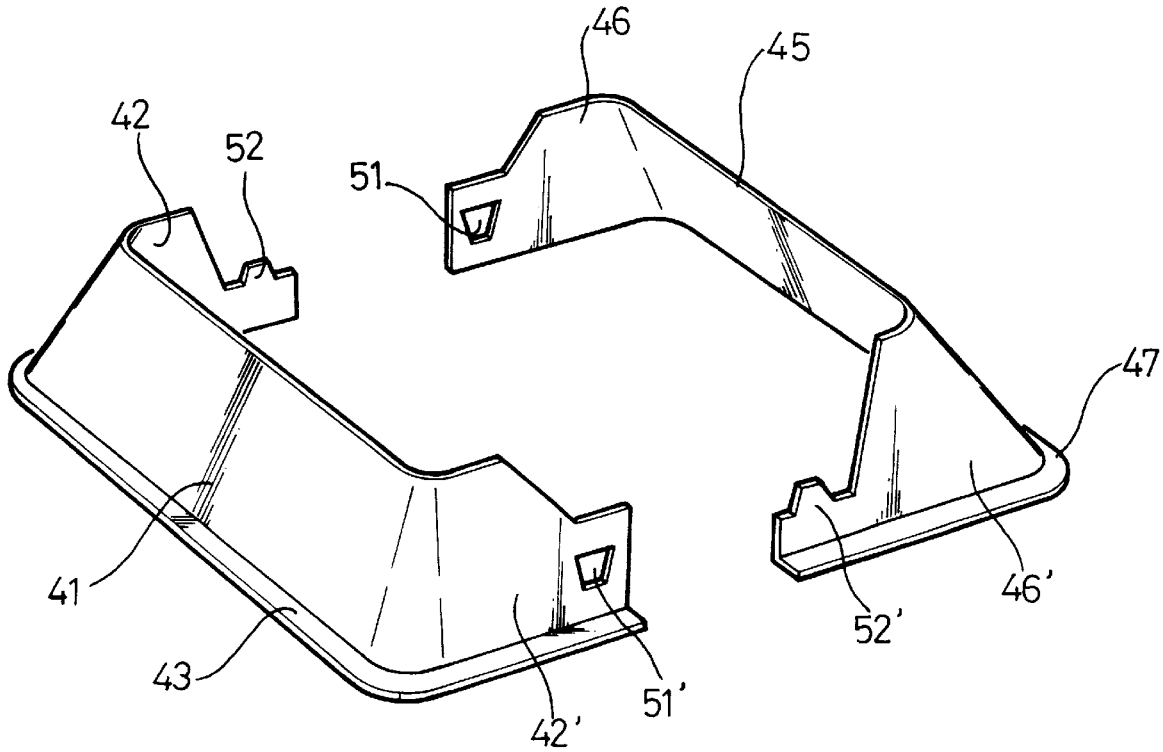
FIG. 3 is an exploded perspective view illustrating an inner shield according to an embodiment of the present invention.

An inner shield for a CRT according to an embodiment of the present invention is shown in FIG. 3. The inner shield includes first and second side walls 41 and 45 facing each other, first half-side walls 42 and 42', and second half-side walls 46 and 46', respectively extending inward from both ends of the first and second side walls 41 and 45. Flanges 43 and 47 are located at the circumference of the lower ends of the first and second side walls 41 and 45 and the first and second half-side walls 42 & 42' and 46 & 46'.

The first and second side walls 41 and 45 are coupled to each other by coupling means of the present invention to form the inner shield.

As shown in FIG. 3, a coupling piece 52 and a coupling hole 51' are located at the first half-side walls 42 and 42', and a coupling hole 51 and a coupling piece 52' corresponding thereto are located at the second half-side walls 46 and 46'. Alternatively, coupling pieces can be located at the first half-side walls 42 and 42', respectively, and coupled holes corresponding to the coupling pieces can be located at the second half-side walls 46 and 46'.

Here, the upper end of the first half-side wall 42 at which the coupling piece 52 extends upwardly is at a position lower than that of the second half-side wall 46 at which the coupling hole 51 is located.

Also, preferably, the coupling holes 51 and 51' are upside-down trapezoids, and the coupling pieces 52 and 42' are trapezoids.

The assembly process of the inner shield having half-side walls according to this embodiment will be described with reference to FIGS. 3, 5, and 6.

To assemble the inner shield, the first half-side walls 42 and 42' are aligned corresponding to the second half-side walls 46 and 46' so that the coupling pieces 52 and 52' are positioned at the coupling holes 51 and 51'.

Figure 5:
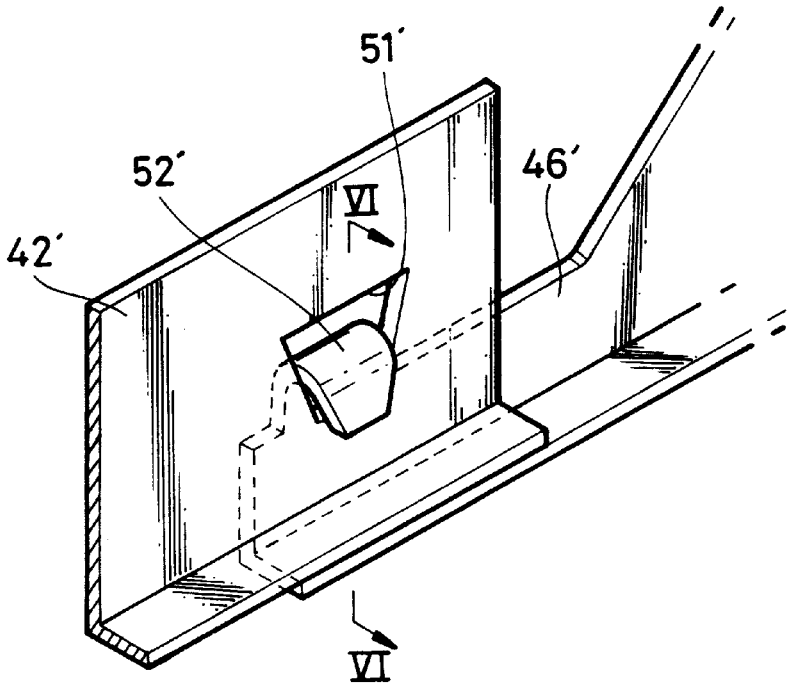
FIG. 5 is a partially exploded perspective view illustrating the coupling state of the inner shield shown in FIG. 3.
Figure 6:
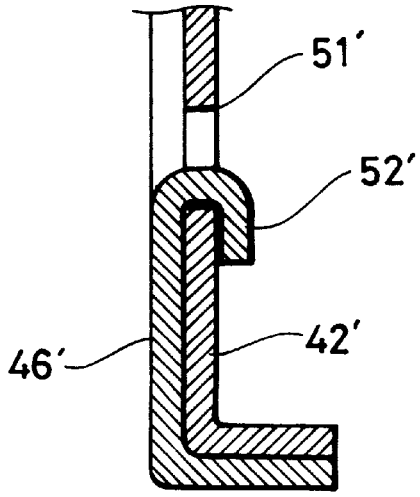
FIG. 6 is a cross-sectional view taken along the line VI—VI shown in FIG. 5.

Subsequently, as shown in FIG. 5, the coupling piece 52' is bent and inserted into the coupling hole 51' couple the half-side walls to each other. Thus, the coupling piece 52' of the second half-side wall 46' is bent to clamp the first half-side wall 52' to support the same. Since the coupling hole 51' is an upside-down trapezoid, and the coupling piece 52' is a trapezoid, they can be securely coupled without shaking.

Also, the structures of the coupling holes 51 and 51' and the coupling pieces 52 and 52' are not limited to this embodiment, and they may take any shapes that can secure their connection.

Figure 4:
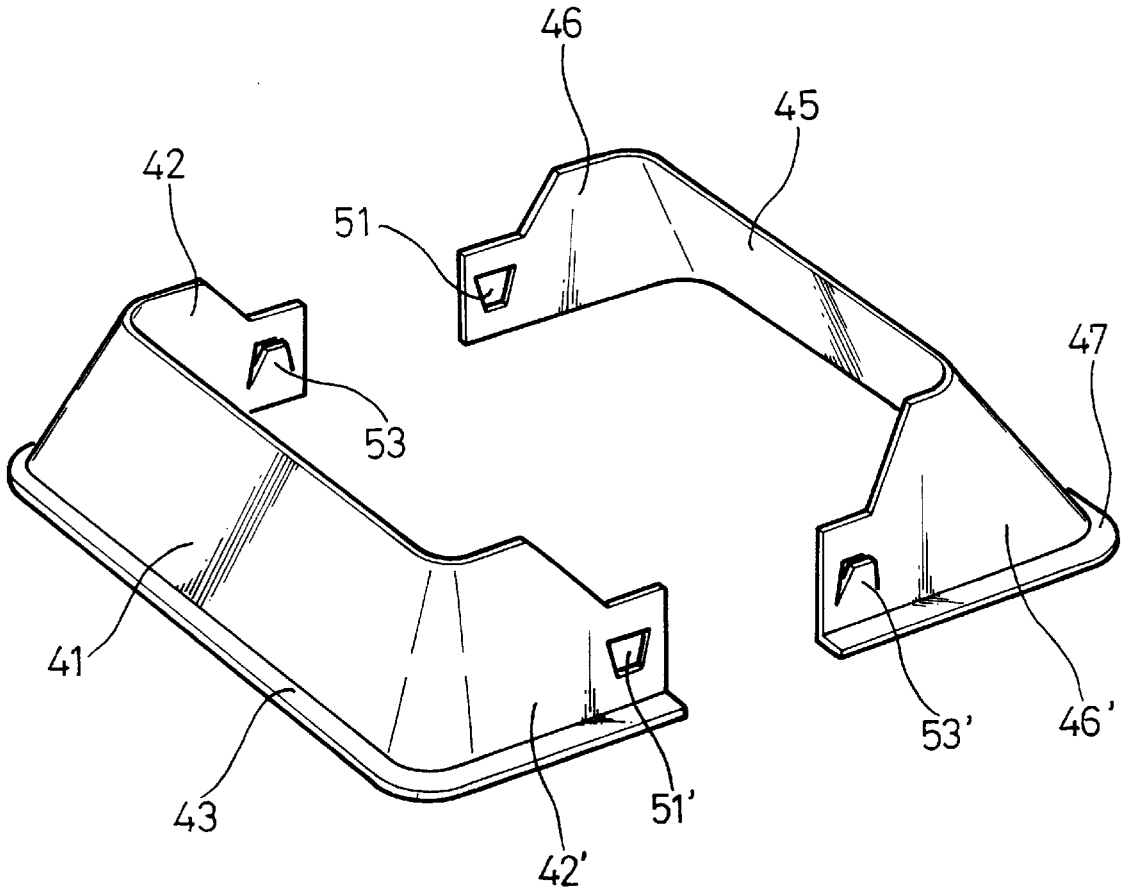
FIG. 4 is a partially exploded perspective view illustrating an inner shield according to another embodiment of the present invention.

For example, as shown in FIG. 4, the first and second half-side walls 42 and 46' may be lanced to form the coupling pieces 53 and 53'.

According to the inner shield of the present invention, since a coupling piece is inserted into a coupling hole and bent to couple the half-side walls to each other, first and second half-side walls do not slip relative to each other and they can be securely coupled.

Although specific embodiments of the invention have been shown in the drawings and described in the foregoing specification, it will be understood that the invention is not limited thereto, but modifications and alterations may be made by one skilled in the art without departing from the spirit of the invention.

What is claimed is:

1. An inner shield for a CRT comprising first and second side walls facing each other, each of the first and second side walls having:

first and second half-side walls extending from respective ends, a coupling piece located on the first half-side wall, and a coupling hole into which the coupling piece is inserted and bent, located in the second half-side wall, the coupling piece and coupling hole coupling corresponding first and second half-side walls to each other.

2. The inner shield for a CRT according to claim 1, wherein the coupling hole has a trapezoidal shape and the coupling piece has a trapezoidal shape.

3. The inner shield for a CRT according to claim 1, wherein the coupling piece extends from an upper edge of the first half-side wall.

4. The inner shield for a CRT according to claim 1, wherein an upper edge of the first half-side wall where the coupling piece is located is lower than an upper edge of the second half-side wall including the coupling hole.

5. The inner shield for a CRT according to claim 1, wherein the coupling piece is formed by punching the first half-side wall.

* * * * *